US012024893B2

(12) United States Patent
Johnson et al.

(10) Patent No.: US 12,024,893 B2
(45) Date of Patent: Jul. 2, 2024

(54) PERMEABLE WATER RESISTIVE ROOF UNDERLAYMENT

(71) Applicant: VAPROSHEILD LLC, Gig Harbor, WA (US)

(72) Inventors: Philip L. Johnson, Spring Lake, MI (US); Kevin D. Nolan, Seattle, WA (US); Daniel Bess, Newbury, OH (US); Adrian deKrom, Cardon, OH (US)

(73) Assignee: VaproShield, LLC, Gig Harbor, WA (US)

( * ) Notice: Subject to any disclaimer, the term of this patent is extended or adjusted under 35 U.S.C. 154(b) by 140 days.

(21) Appl. No.: 18/050,319

(22) Filed: Oct. 27, 2022

(65) Prior Publication Data

US 2023/0175264 A1 Jun. 8, 2023

Related U.S. Application Data

(63) Continuation of application No. 16/602,328, filed on Sep. 18, 2019, now Pat. No. 11,525,265.

(60) Provisional application No. 62/732,908, filed on Sep. 18, 2018.

(51) Int. Cl.
*E04D 5/10* (2006.01)
*E04D 11/02* (2006.01)

(52) U.S. Cl.
CPC ..... *E04D 5/10* (2013.01); *E04D 11/02* (2013.01)

(58) Field of Classification Search
None
See application file for complete search history.

(56) References Cited

U.S. PATENT DOCUMENTS

| | | | |
|---|---|---|---|
| 2,140,026 | A | 12/1938 | Edward |
| 3,440,185 | A | 4/1969 | Hanley |
| 3,445,272 | A | 5/1969 | Newton, Jr. |
| 3,539,388 | A | 11/1970 | Shu-Tung |
| 3,979,867 | A | 9/1976 | Sowinski |
| 4,098,044 | A | 7/1978 | Slavik |
| 4,163,822 | A | 8/1979 | Walter |
| 4,252,590 | A | 2/1981 | Rasen et al. |
| 4,315,392 | A | 2/1982 | Sylvest |
| 4,655,210 | A | 4/1987 | Edenbaum |

(Continued)

FOREIGN PATENT DOCUMENTS

| | | |
|---|---|---|
| CA | 2843707 | 2/2017 |
| CA | 2887478 | 1/2018 |

(Continued)

OTHER PUBLICATIONS

British Board of Agreement, Tyvek (R) Supro Roof Tile Underlayment for Use in Warm Non-Ventilated and Cold Ventilated Roofs, Certificate No. 08/4548, Apr. 8, 2008.

(Continued)

*Primary Examiner* — Christopher T Schatz
(74) *Attorney, Agent, or Firm* — Janeway Patent Law PLLC; John M. Janeway

(57) ABSTRACT

The present invention relates to a water resistant, UV resistant, vapor permeable, air barrier roofing underlayment assembly for use on flat or low sloped roofs comprising a substrate of permeable polyester, a permeable copolymer acrylate coating bonded to the permeable polyester substrate and a pressure sensitive permeable copolymer adhesive secured to the acrylate coating. The permeable coating is a copolymer including a primary polymer of n-butyl acrylate and contains carbon black.

10 Claims, 1 Drawing Sheet

(56) References Cited

U.S. PATENT DOCUMENTS

| | | | |
|---|---|---|---|
| 4,764,412 | A | 8/1988 | Burns |
| 4,815,963 | A | 3/1989 | Berkhout |
| 4,851,272 | A | 7/1989 | Knox, III |
| 5,099,627 | A | 3/1992 | Coulton et al. |
| 5,425,672 | A | 6/1995 | Rotter |
| 5,598,673 | A | 2/1997 | Atkins |
| 5,617,687 | A | 4/1997 | Bussey, Jr. |
| 5,709,651 | A | 1/1998 | Ward |
| 5,960,595 | A | 10/1999 | McCorsley, III et al. |
| 5,973,015 | A | 10/1999 | Coronado et al. |
| 5,993,927 | A | 11/1999 | Sugita et al. |
| 6,131,353 | A | 10/2000 | Egan |
| 6,284,368 | B2 | 9/2001 | Muta |
| 6,316,016 | B1 | 11/2001 | Iwakawa |
| 6,594,965 | B2 | 7/2003 | Coulton |
| 6,804,922 | B1 | 10/2004 | Egan |
| 6,927,267 | B1 | 8/2005 | Varela de la Rosa |
| 6,938,383 | B2 | 9/2005 | Morris et al. |
| 7,117,649 | B2 | 10/2006 | Morris et al. |
| RE39,825 | E | 9/2007 | Morris et al. |
| 7,488,523 | B1 | 2/2009 | Muncaster |
| 7,617,638 | B1 | 11/2009 | Slama et al. |
| 7,651,757 | B2 | 1/2010 | Jones et al. |
| 8,146,310 | B2 | 4/2012 | Keene |
| 8,245,472 | B2 | 8/2012 | Keene |
| 8,387,336 | B2 | 3/2013 | Coulton |
| 8,549,806 | B2 | 10/2013 | Snyder |
| 8,590,267 | B2 | 11/2013 | Jaffee |
| 9,249,060 | B2 | 2/2016 | Herold |
| 9,286,577 | B2 | 3/2016 | Shofner et al. |
| 9,453,337 | B2 | 9/2016 | Fritz |
| 9,783,980 | B2 | 10/2017 | Snyder et al. |
| 10,125,489 | B2 | 11/2018 | Snyder |
| 2002/0037956 | A1 | 3/2002 | Avramidis |
| 2002/0146953 | A1 | 10/2002 | Lubker, II |
| 2003/0232171 | A1 | 2/2003 | Keith |
| 2004/0106346 | A1 | 6/2004 | Zafiroglu |
| 2004/0180195 | A1 | 9/2004 | Macuga |
| 2004/0237464 | A1 | 12/2004 | Khan |
| 2005/0000172 | A1 | 1/2005 | Anderson |
| 2005/0014431 | A1 | 1/2005 | Carmody et al. |
| 2005/0055983 | A1 | 3/2005 | Tomes |
| 2005/0214496 | A1 | 9/2005 | Borenstein |
| 2006/0096218 | A1 | 5/2006 | Johnson |
| 2006/0101758 | A1 | 5/2006 | Egan |
| 2006/0211781 | A1 | 9/2006 | Strandburg |
| 2007/0212520 | A1 | 9/2007 | Furumori et al. |
| 2008/0120935 | A1 | 5/2008 | Lembo |
| 2008/0268224 | A1 | 10/2008 | Kim |
| 2009/0047465 | A1 | 2/2009 | Zafiroglu |
| 2009/0288358 | A1 | 11/2009 | Snyder |
| 2011/0185666 | A1 | 8/2011 | Russell |
| 2011/0312240 | A1 | 12/2011 | Amthor |
| 2012/0244340 | A1 | 9/2012 | Peng |
| 2013/0052401 | A1 | 2/2013 | Snyder |
| 2015/0024159 | A1 | 1/2015 | Bess et al. |
| 2015/0136207 | A1 | 5/2015 | Giron |
| 2015/0307751 | A1 | 10/2015 | Eckhardt |
| 2016/0024782 | A1 | 1/2016 | Bess et al. |
| 2017/0044404 | A1 | 2/2017 | Yamamoto et al. |
| 2017/0174952 | A1 | 6/2017 | Bess et al. |
| 2018/0237662 | A1 | 8/2018 | Widenbrant |

FOREIGN PATENT DOCUMENTS

| | | |
|---|---|---|
| CA | 2887481 | 1/2018 |
| EP | 0397554 | 8/1994 |
| EP | 0874099 | 2/2001 |
| FI | 116226 | 10/2005 |
| GB | 2473618 | 3/2011 |
| JP | H7-138539 | 5/1995 |
| JP | 2001003025 | 1/2001 |
| JP | 07048554 | 5/2022 |
| WO | 200220246 | 3/2002 |
| WO | 2006047130 | 11/2006 |
| WO | 2008067611 | 6/2008 |
| WO | 2009127819 | 10/2009 |
| WO | 2010056372 | 5/2010 |

OTHER PUBLICATIONS

Derwent Abstract of JP 2001-3025.

Cosella-Dorken Products, Inc. Technical Data Sheet for Delta (R)—Fassade S and Delta (R)—Fassade S Plus UV, Dec. 21, 2011.

Cosella-Dorken Products, Inc. Technical Data Sheet for Delta (R)—Vent S.

E.I. du Pont De Nemours and Company, "DuPont Tyvek(R) Providing Protection in Construction".

Irish Agreement Board, "DuPont Tyvek(R) Supro Vapour Permeable Roofing Underlays for Pitched Roofs", Certificate No. 04/0157, Nov. 2004.

PERMEABLE WATER RESISTIVE ROOF UNDERLAYMENT

RELATED APPLICATIONS

The present application is a continuation application of commonly owned, and currently pending, U.S. Utility patent application Ser. No. 16/602,328 filed 18 Sep. 2019 and titled "Permeable Water-Resistive Roof Underlayment", which claims priority from, and incorporates by reference, U.S. Provisional Patent Application 62/732,908 filed 18 Sep. 2018 and titled "Permeable Water-Resistive Roof Underlayment". This continuation application claims priority from both U.S. Utility patent application Ser. No. 16/602,328 and U.S. Provisional Patent Application 62/732,908, and incorporates by this reference all that each of these applications teaches and discloses.

STATEMENT REGARDING FEDERALLY SPONSORED RESEARCH OR DEVELOPMENT

None

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention relates to a building construction membrane, and more particularly to a non-asphaltic roof underlayment that is vapor permeable, forms an air barrier, and is resistant to water and ultra-violet (UV) light. The underlayment can be a component of a roof assembly on both flat and low sloped roofs.

2. Background of the Invention

In the roofing industry, a roofing underlayment is typically applied to a low slope roof to form a vapor and air barrier over which insulation and a roof cover is applied. A primary goal of the low slope roof underlayment is to stop vapor and air. However, in a number of applications, it is preferable to have vapor migration and stop air infiltration. The present invention is directed toward the latter application.

It is known in the prior art that flat or low-sloped roofs are often covered with top roofing membranes. Common among the membranes that have the mechanical properties needed to be technologically useful are thermoset membranes such as EPDM rubber and thermoplastic membranes such as PVC and TPO. These membranes typically contain carbon black, titanium oxide ($TiO_2$) and/or other mineral fillers to add advantageous mechanical properties to the membranes.

In most cases, the roofing underlayment comprises a felt material composed of cellulose or glass fibers or a mixture thereof that is saturated with a bituminous material such as asphalt or pitch. Roofing underlayments that are saturated with a bituminous material can be hazardous to manufacture due to the presence of a flammable bituminous material and can contribute to fire on a construction site or a finished roof assembly. Many of the asphaltic underlayments available in the market tend to wrinkle after being applied to a roofing deck due to minor amounts of moisture. This is especially the case if the underlayments are rained upon. Other common problems are underlayment blowing off due to wind. Another major deficiency of a roofing substrate of asphalt or bituminous material is that the material is non-renewable.

The roofing industry has also developed non-asphaltic, underlayments which are butyl based. There are also other types of non-asphaltic membranes used as underlayments such as polyethylene.

Currently, all of the commercial asphaltic and non-asphaltic underlayments tend to be water-resistant but substantially non-breathable or with no permeability. That is, both asphaltic and non-asphaltic underlayments do not allow water vapor to pass through it. As a result, the moisture from the interior of the roofing assembly is trapped in the roof composite of insulation and top roofing membranes and is unable to escape to the exterior atmosphere resulting in damage to the roof over a number of years. Furthermore, asphaltic membranes can degrade due to UV radiation from the sun.

U.S. Pat. No. 4,511,619 issued Apr. 16, 1985 discloses a sealing sheet for the building industry made up of at least one layer that contains filler such as carbon black mixed with an ethylene-propylene copolymer which has a reinforcing laminate in place. The reinforcing layer can be formed of a fabric, a mat, a knitted material, a non-woven material, a synthetic resin or a glass fiber.

U.S. Patent Application Publication Number 2014/0072751 published Mar. 13, 2014 discloses a single-ply polymer coated substrate with at least one adhesive layer for structural water proofing.

U.S. Pat. No. 8,309,211 issued Nov. 13, 2012 discloses a roofing underlayment substrate that is permeable transmitting water vapor at a minimum of 3 perms, water resistant and skid-resistant. The roofing underlayment includes a woven or non-woven substrate having at least one surface which includes a breathable thermoplastic film which also imparts water-resistant to the substrate.

U.S. Pat. No. 8,347,576 issued Jan. 8, 2013 discloses a single-ply mechanically embossed roofing membrane in roll form for use in commercial application on flat and low pitched roofs.

None of the aforementioned references appear to be permeable to allow meaningful transmissions of water vapor or are designed to be UV resistant or attempt to prevent or preclude mold, mildew, rot from forming on a substantially flat roof structure.

These teachings do not aid in the resolution of a number of practical difficulties that are resolved by the present invention.

In view of the drawbacks mentioned above with prior art non-asphaltic underlayments, there is a need for providing a non-asphaltic self adhering roofing underlayment that is a breathable air barrier thereby allowing moisture in the form of water vapor to escape from inside the roof assembly, while preventing water vapor moisture from destroying the roofing composite of insulation and roofing membrane. In addition, UV-resistance is a highly desirable property of an underlayment.

SUMMARY OF THE INVENTION

The present invention is directed towards a flat roofing self-adhering underlayment that is water resistive, UV resistant and a vapor permeable air barrier. The roofing underlayment is a polyester substrate which is coated with a foamed n-butyl acrylate copolymer containing carbon black and cured to maintain air bubble pores in place. A permeable pressure sensitive copolymer adhesive coating having a back bone of n-butyl acrylate, 2-ethylhexyl acrylate and vinyl acetate is foamed and coated over the n-butyl acrylate copolymer coating, bonding to the coating with a reduction in tackiness in the adhesive which may eliminate the need for a slip sheet in some usages. After curing, the pressure sensitive adhesive, coating and substrate is laminated.

In one particular embodiment, a single-ply permeable polyester substrate has a permeable acrylate coating on the bottom side of the base substrate and a permeable adhesive applied over the acrylate coating.

BRIEF DESCRIPTION OF THE DRAWINGS

The present invention will be described with reference to the appended Figures, in which.

These and other objects, advantages, and novel features of the present invention will become apparent when considered with the teachings contained in the detailed disclosure along with the accompanying drawings.

DESCRIPTION OF THE INVENTION

Figure 1:
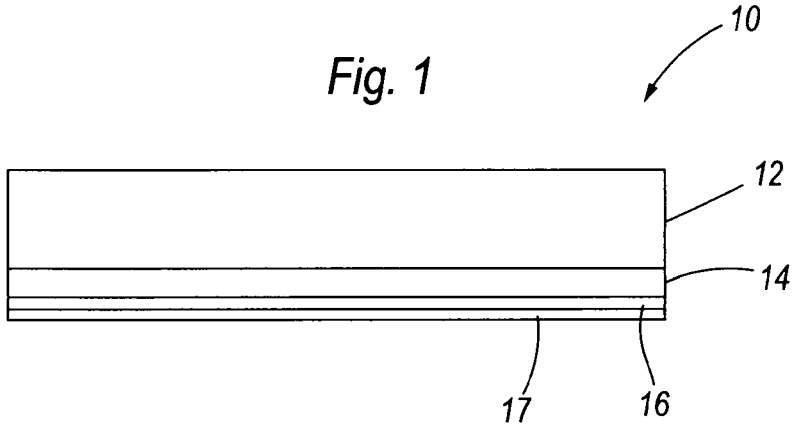
FIG. 1 is a schematic enlarged cross sectional view of the inventive underlayment used on a typical flat roof construction.
Figure 2:
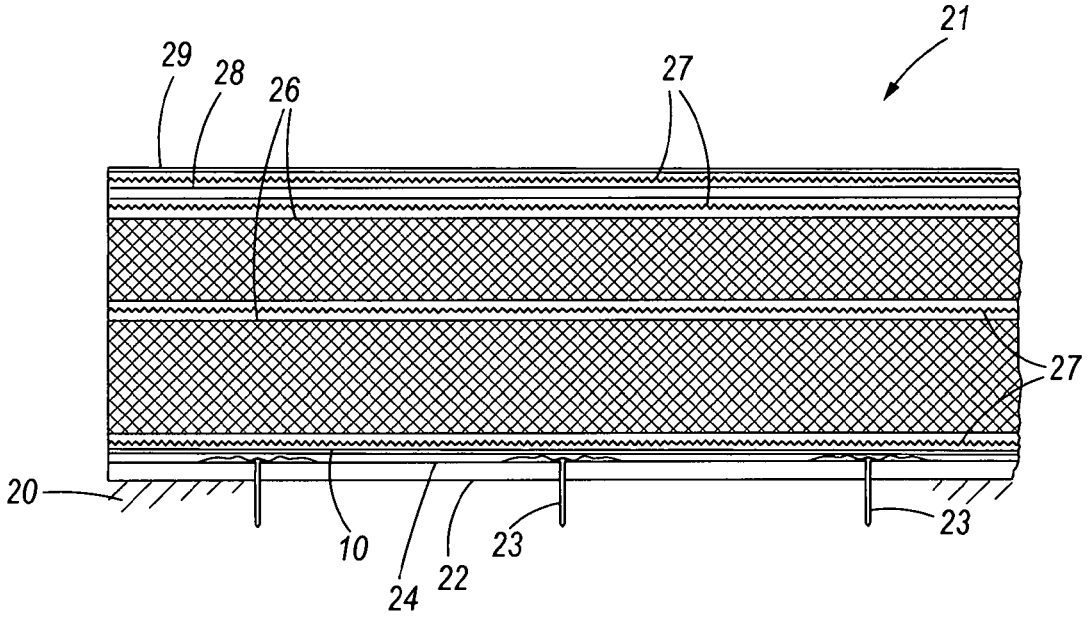
FIG. 2 is a schematic cross section view of a typical flat roof system with the inventive underlayment.

The present invention is directed toward a self-adhering water-resistant vapor permeable roofing underlayment membrane as shown in FIG. 1 which can be successfully used to cover flat and low sloped roofs ranging from about 0° to about 2° in slope as is shown in FIG. 2. Roofs from about 0° to about 5° can also be covered. The self-adhering roofing system is a UV stabilized, vapor permeable, water resistant, air barrier and is also rot proof and tear resistant. With vapor permeance ranging from about 25 perms to about 45 perms, most preferably about ≥35 perms, the underlayment membrane 10 allows the roof assembly to breathe or "dry out" as necessary during the seasonal changes. This helps to reduce or eliminate conditions that are conducive to mold, mildew, lumber distortion, insulation deterioration and metal corrosion. The drying aspect is of utmost importance in energy efficiency with single ply constructs in humid localities.

The present roof underlayment 10 as seen in FIG. 1 is constructed of permeable polyester sheet or membrane 12 of material ranging from about 180 mils to about 220 mils in thickness with a permeability ranging from about 65 perms to about 80 perms with a preferred permeability of about 75 perms. The polyester sheet 12 is premade and packaged in rolls which are unrolled at the manufacturing facility and coated at different stages. In some selected usages, permeable polypropylene can be used. The sheet of polyester which forms the substrate 12 of the underlayment 10 is coated with a permeable n-butyl acrylate copolymer coating 14 by a knife over roller in the first process stage.

The coating 14 is mixed prior to application on the polyester base layer and run through a foamer (high speed dispersion mixer) so that it formed with encapsulated air bubbles. These air bubbles are interconnected in the copolymer to form a permeable coating ranging from about 80 mils to about 100 mils in thickness with a permeability ranging from about 30 perms to about 60 perms when it is cured. The coating 14 is coated on the substrate 12 with a knife and roller in a wet application. The coating 14 is a wet foamed copolymer with the primary monopolymer being n-butyl acrylate mixed with another acrylate monopolymer.

Acrylates are the salts, esters and conjugate bases of acrylic acid and its derivatives. Acrylates contain vinyl groups; that is two carbon atoms double bonded to each other, directly attached to the carbonyl carbon.

Other polymers which can be mixed with the n-butyl acrylate are methyl acrylate, methyl methacrylate and methyl acrylic acid. Carbon black at approximately 1% by weight of the copolymer solution is added to the copolymer. A suitable copolymer base coating is manufactured by BASF SE Corporation and sold under the trademark ACRONAL® 4250. This coating has a viscosity of 300 and a density (lb/gal of 8.6) with pH of about 7.7 with a temperature low point of −28° C.

The n-butyl acrylate polymer in the coating 14 ranges from 20 to 55% solids, with a pH ranging 7.7 to 8.0, and a preferred viscosity at 73° F. (cps) of 300 using a Brookfield RV viscometer Spindle #4 @ 100 rpm. The viscosity can effectively range from 100 to 500 depending on the percentage of solids. As previously noted, carbon black is also added to the copolymer to reduce tackiness, add strength and increase the UV effectiveness of the underlayment. The copolymer is foamed with a high speed dispersion mixer at 700 rpm with a 32% air injection with entrained air bubbles so that it has a foam density ranging from about 50% to about 65% preferably from about 55% to about 60%. The coating 14 is applied to the polyester substrate 12.

The coating 14 is then heat cured after leaving the coating blade setting the foamed air bubbles in place in the copolymer providing the coating with permeability. The coating 14 copolymer ranges from about 30% to about 98% n-butyl acrylate.

A copolymer pressure sensitive adhesive 16 is run through a second foamer so that it is formed with encapsulated air bubbles and is then applied to the cured acrylate coating 14 by a second blade coater, at a thickness ranging from about 4 mils to about 10 mils and cured as previously noted for the coating 14 to lock the air bubbles in place. Suitable pressure is applied to laminate the underlayment and the pressure sensitive adhesive has a preferred thickness of about 5 mils. The completed underlayment 10 has a permeability ranging from about 25 perms to about 45 perms and a preferred range from about 30 perms to about 40 perms.

The copolymer portion of the pressure sensitive adhesive (PSA) 16 has a backbone consisting of n-butyl acrylate, 2-ethylhexyl acrylate, and vinyl acetate. The structure of the backbone is shown in Table I below as follows:

TABLE I (Structure of PSA Polymer Backbone)

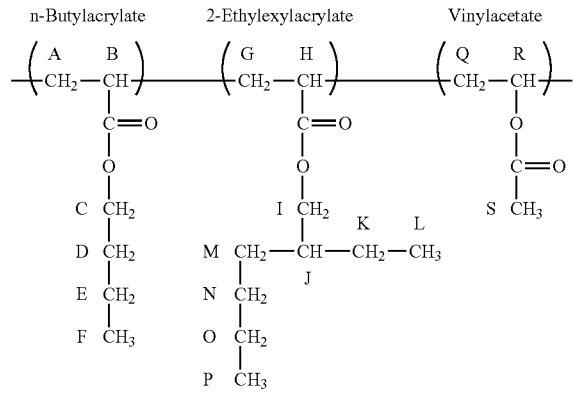

The adhesive fully bonds to the coating 14 for air tightness and ease of installation and requires no primer for use on any substrate.

The pressure sensitive adhesive (PSA) is an acrylic solution. The polymeric portion of the PSA makes up at least 95% of the adhesive formulation and has a copolymer backbone of n-butyl acrylate (about 60% by weight), 2-ethylhexyl acrylate (about 32% by weight) and vinyl acetate (about 7% by weight) forming a copolymer blend capable of bonding and crosslinking with the coating 14. Proper foaming of the adhesive is critical to good micropore formation. The aeration process includes high sheer mixing to entrain air in the mixed adhesive liquid solution. This is the same aeration process used for the coating. The self-adhering adhesive 16 is evenly applied on the n-butyl acrylate coating, cured and the micropores are formed and fixed throughout the PSA. The coating method used with the present invention for both the coating 14 and the PVA 16 was accomplished with a blade coater. This is a non-contact coating method and it does not crush or destroy the foam in the copolymer during coating. After application, the adhesive must be heated to lock-in the micropore formation. The adhesive in the present invention was reformulated by adding surfactants and water to the copolymer to control bubble size, bubble density, viscosity, and stability of the copolymer. The peel value of the adhesive is reduced by the introduction of voids (air bubbles) and the addition of carbon black and a surfactant such as long chain alcohols create a stable inverse emulsion.

The acrylate polymer coating 14 does not require a slip sheet when applied. It is dry enough to be rolled onto itself. The pressure sensitive adhesive 16 is applied to a siliconized release film 17 and then laminated to the polyester and coating composite.

Microscopy of the modified adhesive surface was performed revealing a porous structure of the adhesive having a bubble density (number of pores) ranging from about 4000 pores in 1.0 $in^2$ to about 4600 pores in 1.0 $in^2$, preferably about 4400 pores in 1.0 $in^2$ with a majority of the pores, preferably about 80% to about 90% of the bubbles/pores having a size ranging from about 200 microns to about 300 microns. The pores formed are generally round and oval in shape and form a vapor pathway through the adhesive layer. The majority of the pores 100 formed by the bubbles appear to be distributed evenly across the surface penetrating through the adhesive layer when the polymer mixture is heat treated to set the pores in the adhesive. Preferably, the density of the foamed adhesive should fall between about 0.65 and about 0.75 after aeration.

The adhesive copolymer which was manufactured and as shown in Table I ranges from about 45% by weight to about 50% by weight, preferably about 48% to about 49% by weight. The copolymer was mixed with a first solvent-free, surfactant-based wetting agent, preferably ranging from about 4% by weight to about 6% by weight, and most preferably about 5% by weight to provide emulsification and bubble size; and a second surfactant such as a foaming agent ranging from about 1.5% by weight to about 2.0% by weight, and preferably about 1.7% by weight to provide foam formation. A polymeric based thickener was added to the mixture in a range from about 0.2% by weight to about 0.4% by weight, preferably about 0.30% by weight. The adhesive copolymer composition was added to water ranging from about 40% by weight to about 50% by weight, preferably about 43% by weight to about 45% by weight and mixed in a high speed dispersion mixer at 500 rpm to form uniform bubbles in the mixture and fed into a coater feeder as previously described. The foamed adhesive was coated onto the cured porous n-butyl acrylate coating and heat cured to form the pores in place in the copolymer. The pressure sensitive adhesive and underlayment is laminated to reduce tackiness of the pressure sensitive adhesive and the need for a slip sheet.

For industry testing standards, the present underlayment 10 will support a water column of twenty four (24) inches of water for forty eight (48) hours.

Construction of a typical roof composite for a commercial flat roof 20 using the underlayment is shown in FIG. 2. In FIG. 2, a typical construction of a flat composite deck roof deck 21 using the inventive underlayment 10 which allows for drying of the roof composite from the inside out is shown. In this embodiment, a ½ inch mechanically attached thermal barrier board 24 fastened to the metal roof deck 22 by mechanical fasteners such as screws or nails 23. The permeable membrane underlayment 10 of the present invention is mounted on the barrier board 24 and secured thereto by the pressure sensitive adhesive 16. Two layers of polyiso 26, 3 inches and 2.2 inches, (5.2 inches total), thickness as needed for insulation value, are set in low rise foam adhesive 27. A ½ inch cover board 28 is set in low rise foam adhesive 27 which has been layered on the top polyiso layer 26 and the roof is covered with a PVC, or other single ply roof membrane 29 which is also set in low rise foam adhesive 27.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What is claimed is:

1. A method for constructing a roof composite for a flat roof, the method comprising:

mounting an underlayment that is an air barrier and self-adhering, vapor-permeable, water-resistive, and UV-resistant, to a first component of a roof, the underlayment comprising:

a substrate of polyester having a surface;

a foamed, permeable copolymer coating attached to the polyester substrate's surface, wherein the foamed, permeable copolymer coating includes an n-butyl acrylate copolymer that:

includes n-butyl acrylate in an amount ranging from 30% to 98% by weight, and has a foam density that ranges from 50% to 65% of the copolymer's density before foaming; and a permeable pressure-sensitive adhesive bonded to said foamed, permeable copolymer coating, the underlayment having a permeability of 25 perms or more; and mounting a second roof component, that shields the roof's first component and the underlayment from an external environment, to the first roof component such that the underlayment lies between the first and second roof components.

2. The method of claim 1 wherein the first component of the roof includes a metal roof deck.

3. The method of claim 1 wherein the first component of the roof includes a thermal barrier board and the underlayment is mounted onto the thermal barrier board.

4. The method of claim 1 wherein the underlayment's permeable pressure sensitive adhesive helps secure the underlayment to the roof's first component.

5. The method of claim 1 wherein the second component of the roof includes a single ply roof membrane.

6. The method of claim 1 wherein the second component of the roof includes insulation that is mounted to the underlayment with an adhesive.

7. The method of claim 1 wherein the roof being constructed is a new roof that was not previously constructed.

8. The method of claim 1 wherein the roof constructed is a commercial roof.

9. The method of claim 1 wherein the foamed permeable copolymer coating has a permeability in the range of from about 30 perms to about 60 perms.

10. The method of claim 1 wherein the underlayment has a permeability in the range of from about 25 perms to about 45 perms.

* * * * *